US007108412B2

(12) United States Patent
Ishida et al.

(10) Patent No.: US 7,108,412 B2
(45) Date of Patent: Sep. 19, 2006

(54) HEADLAMP FOR VEHICLE

(75) Inventors: Hiroyuki Ishida, Shizuoka (JP); Kiyoshi Sazuka, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 111 days.

(21) Appl. No.: 10/809,871

(22) Filed: Mar. 26, 2004

(65) Prior Publication Data

US 2004/0252517 A1 Dec. 16, 2004

(30) Foreign Application Priority Data

Mar. 31, 2003 (JP) ..... P.2003-097080

(51) Int. Cl.
*F21V 7/00* (2006.01)

(52) U.S. Cl. ..... 362/518; 362/519; 362/545

(58) Field of Classification Search ..... 362/518, 362/519, 545

See application file for complete search history.

(56) References Cited

U.S. PATENT DOCUMENTS 6,814,475 B1 * 11/2004 Amano ..... 362/487

2004/0156211 A1 * 8/2004 Blusseau ..... 362/545

FOREIGN PATENT DOCUMENTS

| | | |
|---|---|---|
| JP | 2001-176310 A | 6/2001 |
| JP | 2001-332104 A | 11/2001 |
| JP | 2002-331867 A | 11/2002 |

* cited by examiner

*Primary Examiner*—Stephen F Husar
*Assistant Examiner*—Meghan K. Dunwiddie
(74) *Attorney, Agent, or Firm*—Sughrue Mion, PLLC

(57) ABSTRACT

A vehicle headlamp structure includes a light distribution pattern having a horizontal cutoff line formed by a first reflecting optical system. The structure includes a first light source including a light emitting diode in which a rectangular light emitting chip is covered with a hemispherical mold lens, and a first reflector for reflecting a light emitted from the first light source toward a front part of a lighting unit. In that case, the first light source is provided in such a manner that the light emitting chip is turned in a horizontal direction with one side of the light emitting chip set horizontally. The horizontal cutoff line is formed by selectively utilizing a light emitted from the first light source and reflected by the first reflector, which is reflected in a reflecting region Za positioned in an almost front direction of the light emitting chip.

20 Claims, 6 Drawing Sheets

HEADLAMP FOR VEHICLE

The present application claims foreign priority based on Japanese Patent Application No. 2003-097080, filed Mar. 31, 2003, the contents of which are incorporated herein by reference.

BACKGROUND OF THE INVENTION

1. Field of the Invention

The present invention relates to a vehicle headlamp that forms a light distribution pattern having a horizontal cutoff line by a reflecting optical system comprising a light source including a semiconductor light emitting unit.

2. Background of the Related Art

In a related art marker lamp for a vehicle, such as a tail lamp, a light emitting diode has often been used as a light source. For example, JP-A-2001-332104, the contents of which is incorporated herein by reference, discloses a marker lamp for a vehicle in which a plurality of lighting units using light emitting diodes as light sources are arranged.

In recent years, the luminance of the related art light emitting diode has been enhanced. Therefore, there is a growing tendency to employ the light emitting diode as the light source of a headlamp for a vehicle.

However, a large number of light emitting diodes have such a structure that an almost rectangular light emitting chip is covered with an almost hemispherical mold lens as described in the above-referenced JP-A-2001-332104. When the light emitting diode is employed as the light source of the vehicle headlamp, various related art problems occur.

For example, but not by way of limitation, in the related art vehicle headlamp, it is necessary to employ a structure in which a light distribution pattern having a horizontal cutoff line can be formed so as not to produce glare to a driver in an oncoming car. In that case, the light distribution pattern is formed as the aggregate of the inverted image of a light source in a headlamp for a vehicle having a reflecting optical system that reflects a light emitted from the light source toward the front part of a lighting unit by a reflector.

At this time, the image of a light emitting chip is greatly deformed, depending on the position of a light incidence on the reflector by the convex lens action of a mold lens. Therefore, a horizontal cutoff line cannot be formed clearly. For this reason, there is a related art problem in that the generation of glare cannot be suppressed effectively.

SUMMARY OF THE INVENTION

It is an object of the invention to provide a vehicle headlamp capable of effectively suppressing generation of glare when a light distribution pattern having a horizontal cutoff line is formed by a reflecting optical system that includes a light source having a semiconductor light emitting unit. However, the present invention need not address this object, or any other objects.

To achieve at least the foregoing object, the present invention provides a reflecting optical system that includes a vehicle headlamp constituted to form a light distribution pattern having a horizontal cutoff line by a first reflecting optical system comprising a first light source including a semiconductor light emitting unit in which an almost rectangular light emitting chip is covered with an almost hemispherical mold lens and a first reflector for reflecting a light emitted from the first light source toward a front part of a lighting unit. In the foregoing system, the first light source is provided such that the light emitting chip is turned in an almost horizontal direction with one side of the light emitting chip set almost horizontally, and the first reflecting optical system forms the horizontal cutoff line by selectively utilizing a light emitted from the first light source and reflected by the first reflector which is reflected in a reflecting region positioned in an almost front direction of the light emitting chip.

The "light distribution pattern having a horizontal cutoff line" may be a so-called light distribution pattern for a low beam, and other light distribution patterns may be used.

The type of the "semiconductor light emitting unit" is not particularly restricted but a light emitting diode or a laser diode can be employed, for example but not by way of limitation.

While the "first light source" has the light emitting chip provided in the almost horizontal direction, the specific orientation of the almost horizontal direction is not particularly restricted, but may employ a destination toward the side of the lighting unit or an inclined destination to the side of the lighting unit in a longitudinal direction, for example but not by way of limitation.

DETAILED DESCRIPTION OF THE INVENTION

An exemplary, non-limiting embodiment of the present invention will be described below with reference to the drawings.

Figure 1:
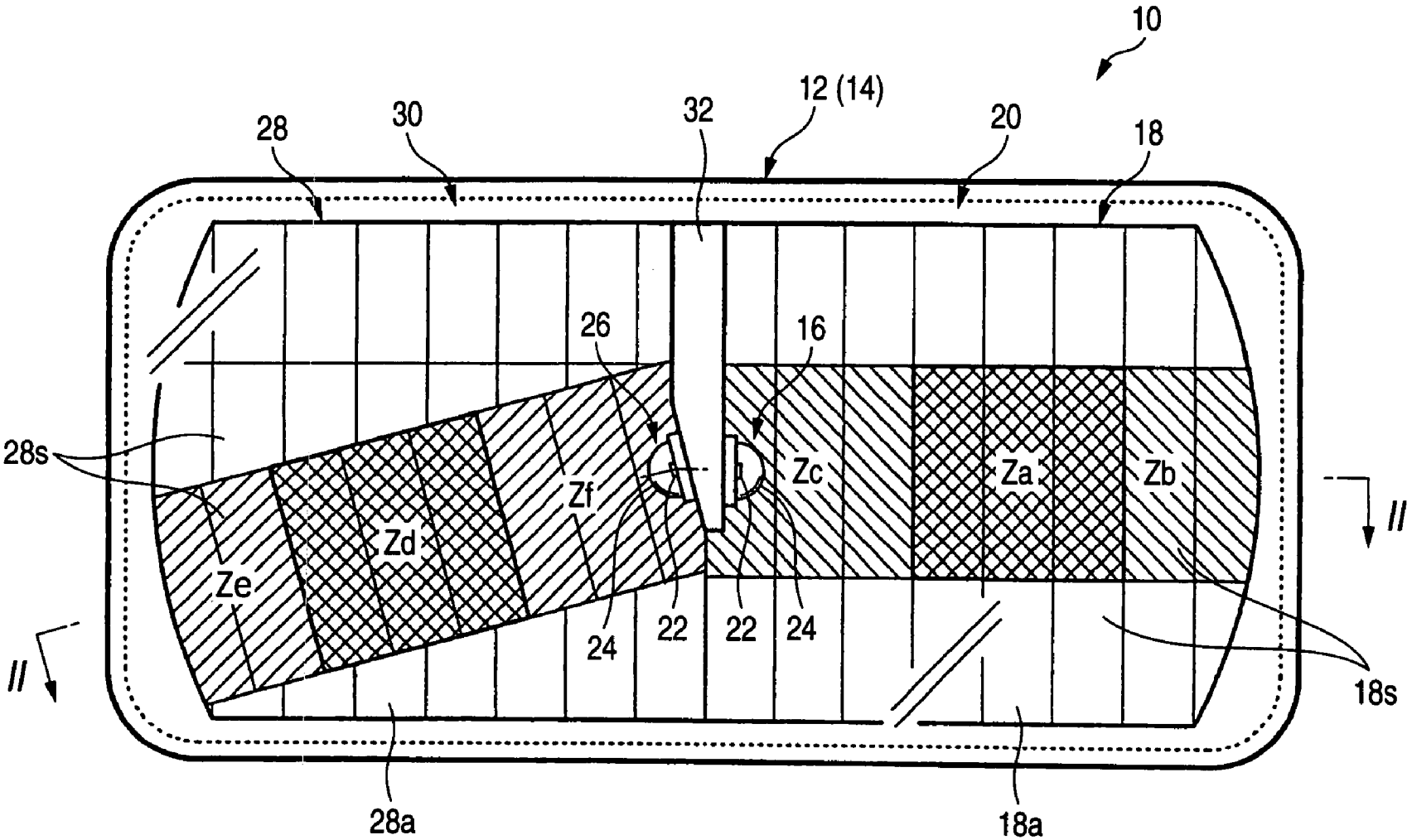
FIG. 1 is a front view showing a headlamp for a vehicle according to an exemplary, non-limiting embodiment of the present invention.
Figure 2:
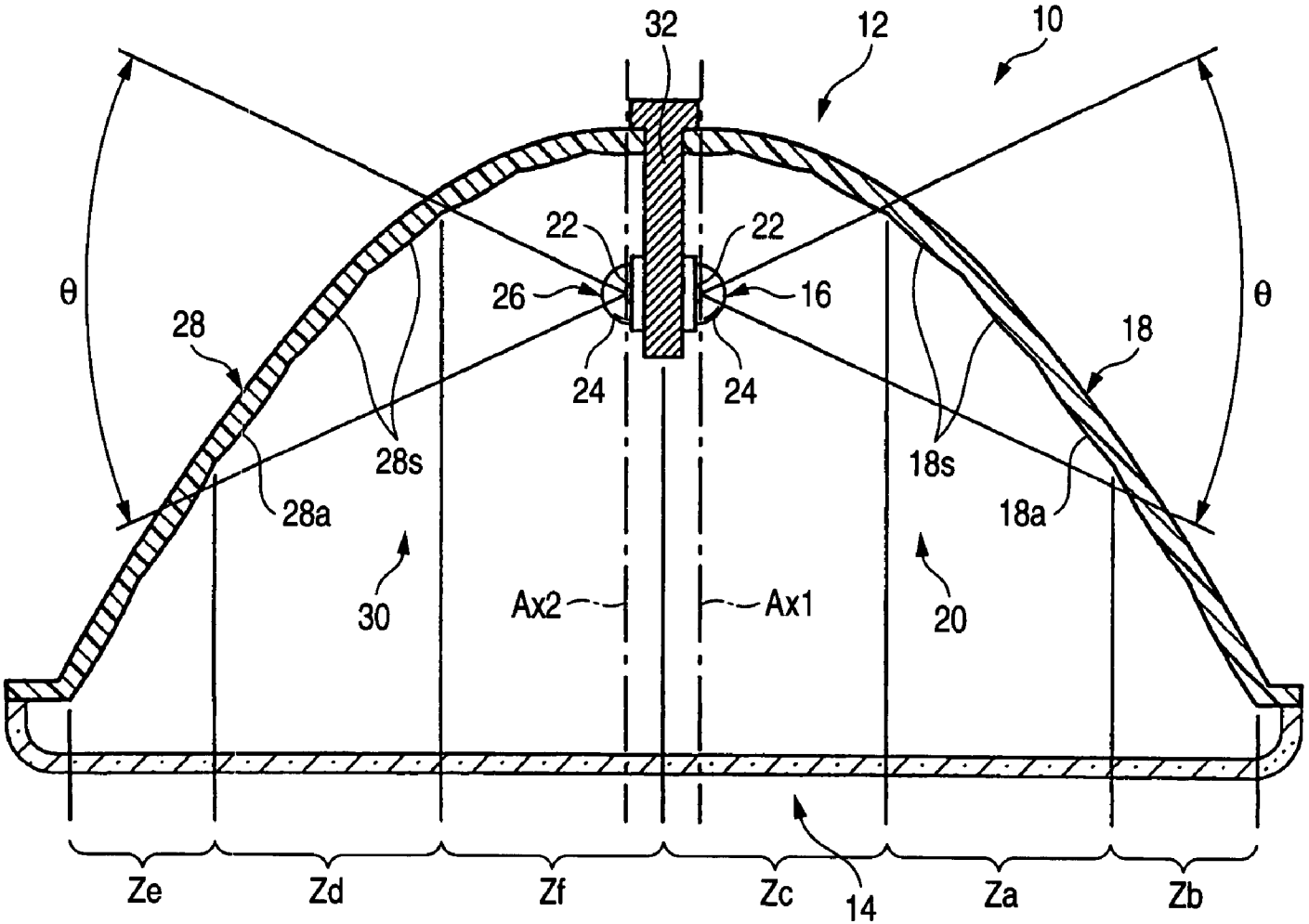
FIG. 2 is a sectional view taken along a line II—II in FIG. 1 according to an exemplary, non-limiting embodiment of the present invention.

FIG. 1 is a front view showing a headlamp 10 for a vehicle according to an exemplary, non-limiting embodiment of the present invention, and FIG. 2 is a sectional view taken along a line II—II in FIG. 1.

The headlamp 10 for a vehicle is a lighting unit that forms a light distribution pattern for a low beam, and includes a reflector unit 12 and a transparent cover 14 attached to an opening portion on the front end of the reflector unit 12.

The reflector unit 12 includes a first reflecting optical system 20 having a first light source 16 and a first reflector 18, and a second reflecting optical system 30 having a second light source 26 and a second reflector 28. Both of the first and second light sources 16 and 26 include light emitting diodes formed by covering rectangular light emitting chips 22 with hemispherical mold lenses 24, and are supported by a common holder 32. Moreover, the first and second reflectors 18 and 28 are formed integrally.

The first light source 16 is provided such that the light emitting chip 22 is turned in a left and horizontal direction with one side of the light emitting chip 22 set horizontally. On the other hand, the second light source 26 is provided in such a manner that the light emitting chip 22 is turned in a downward inclined direction at about 15 degrees to a right and horizontal direction with one side of the light emitting chip 22 set horizontally.

A reflecting surface 18*a* of the first reflector 18 is provided with a plurality of reflecting units 18*s* by setting, as a central axis, an optical axis Ax1 extended in a longitudinal direction to pass through the center position of the surface of the light emitting chip 22 in the first light source 16 and using, as a reference plane, a paraboloid of revolution setting the center position of the surface of the light emitting chip 22 to be a focal point.

On the other hand, a reflecting surface 28*a* of the second reflector 28 is provided with a plurality of reflecting units 28*s* by setting, as a central axis, an optical axis Ax2 extended in a longitudinal direction to pass through the center position of the surface of the light emitting chip 22 in the second light source 26 and using, as a reference plane, a paraboloid of revolution setting the center position of the surface of the light emitting chip 22 to be a focal point.

Figure 3:
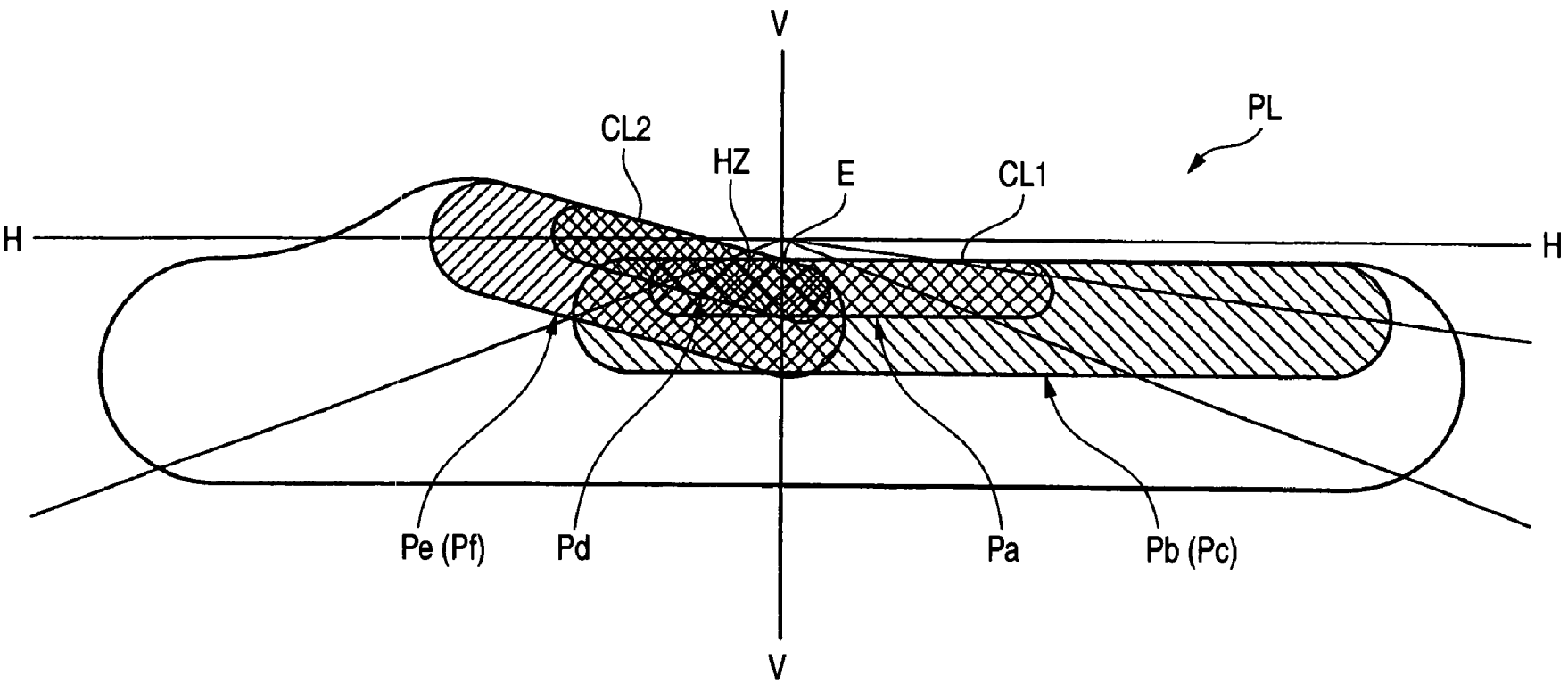
FIG. 3 is a perspective view showing a light distribution pattern for a low beam formed on a virtual vertical screen positioned 25 m away from a front of a lighting unit, with a light irradiation from the vehicle headlamp according to an exemplary, non-limiting embodiment of the present invention, FIGS. 4(*a*)–4(*b*) are views showing how a light emitting chip is observed when a light emitting diode constituting a first light source of the vehicle headlamp is observed from an outside according to an exemplary, non-limiting embodiment of the present invention.

FIG. 3 is a perspective view showing a light distribution pattern PL for a low beam formed on a virtual vertical screen 25 m in front of a lighting unit with a light irradiated forward from the headlamp 10.

The light distribution pattern PL for a low beam is a left light distribution pattern having horizontal and oblique cutoff lines CL1 and CL2 on an upper edge thereof. The light distribution pattern is formed as a synthetic light distribution pattern obtained by two light distribution patterns formed by means of the first and second reflecting optical systems 20 and 30.

In the low beam light distribution pattern PL, the position of an elbow point E at an intersection of both cutoff lines CL1 and CL2 is set downward by approximately 0.5 to 0.6 degree of H-V as a vanishing point in the front direction of the lighting unit, and a hot zone HZ as a region having a high luminous intensity is formed in a slightly leftward position with respect to the elbow point E.

In the light distribution pattern PL for a low beam, a horizontal cutoff line forming pattern Pa for forming the horizontal cutoff line CL1 is formed by a light reflected from a reflecting region Za positioned substantially in front of the light emitting chip 22 of the first light source 16 in the reflecting surface 18*a* of the first reflector 18. This is shown more specifically in FIG. 2.

Horizontal cutoff line reinforcing patterns Pb and Pc for reinforcing the horizontal cutoff line forming pattern Pa are formed by a light reflected from a reflecting region Zb positioned on an outer peripheral side of the reflecting region Za, and a light reflected from a reflecting region Zc positioned on an inner peripheral side thereof.

In the light distribution pattern PL for a low beam, an oblique cutoff line forming pattern Pd for forming the oblique cutoff line CL2 is formed by a light reflected from a reflecting region Zd positioned substantially in front of the light emitting chip 22 of the second light source 26 in the reflecting plane 28*a* of the second reflector 28. Oblique cutoff line reinforcing patterns Pe and Pf for reinforcing the oblique cutoff line forming pattern Pd are formed by a light reflected from a reflecting region Ze positioned on an outer peripheral side of the reflecting region Zd and a light reflected from a reflecting region Zf positioned on an inner peripheral side thereof.

Portions other than the oblique cutoff line forming patterns Pa and Pd and the oblique cutoff line reinforcing patterns Pb, Pc, Pe and Pf in the light distribution pattern PL for a low beam are formed by lights reflected from regions other than the reflecting regions Za, Zb and Zc on the reflecting surface 18*a* and regions other than the reflecting regions Zd, Ze and Zf on the reflecting surface 28*a*.

As described above, in the first and second reflecting optical systems 20 and 30, the horizontal cutoff line CL1 and the oblique cutoff line CL2 are formed by selectively utilizing the lights reflected from the first and second reflectors 18 and 28, which are reflected in the reflecting regions Za and Zd positioned substantially in front of the light emitting chips 22 of the first and second light sources 16 and 26. The foregoing occurs for at least the following reasons.

Figure 4:
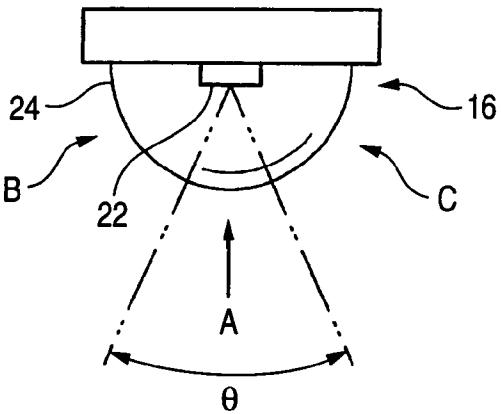
Figure 4:
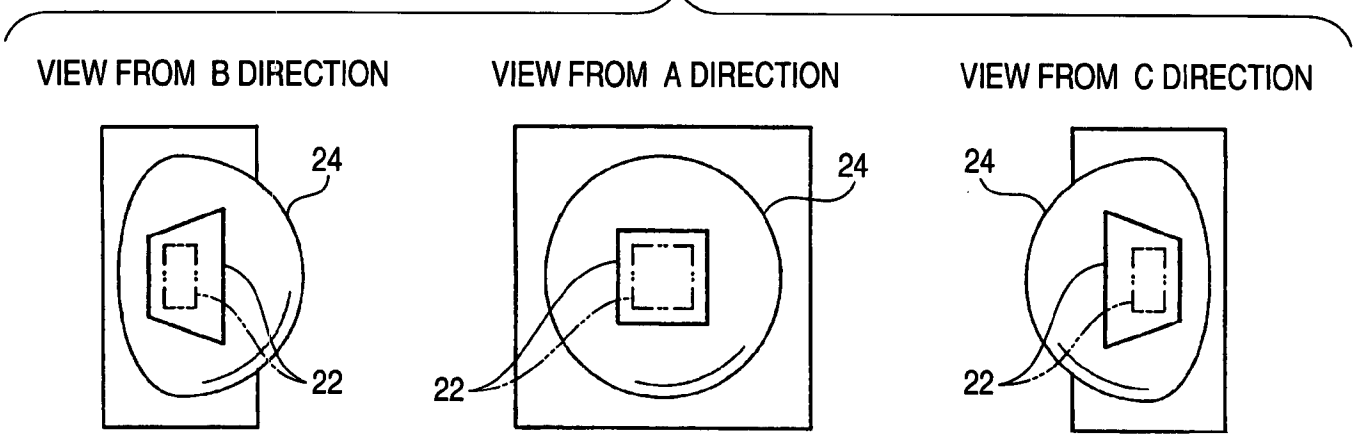

As shown in FIG. 4(*a*), when the light emitting diode constituting the first light source 16 is observed from the outside, the light emitting chip 22 is seen enlargingly by the convex lens action of the mold lens 24. At this time, the shape of the light emitting chip 22 appears distorted greatly depending on a direction of observation.

More specifically, in FIG. 4(*b*), the light emitting chip 22 originally having a shape shown by a two-dotted chain line appears enlarged as shown by a solid line. In other words, when the first light source 16 is observed in a front direction, the light emitting chip 22 is seen with an almost rectangular shape maintained as seen in a direction of an arrow A in FIGS. 4(*a*)–(*b*). When the observation is carried out in a direction substantially shifted from the front direction, the light emitting chip 22 appears deformed in a substantially trapezoidal shape, as seen in a direction of an arrow B or arrow C in FIGS. 4(*a*)–(*b*). In that case, the shape of the light emitting chip 22 can be regarded to be almost rectangular within a range of an angle θ around the front direction of the light emitting chip 22. The angle θ has a value of approximately 50 degrees.

As shown in FIG. 2, a region positioned within a range of the angle θ on the reflecting surface 18*a* of the first reflector 18 is set to be the reflecting region Za. Furthermore, a region positioned within a range of the angle θ on the reflecting surface 28*a* of the second reflector 28 is set as the reflecting region Zd.

Figure 5:
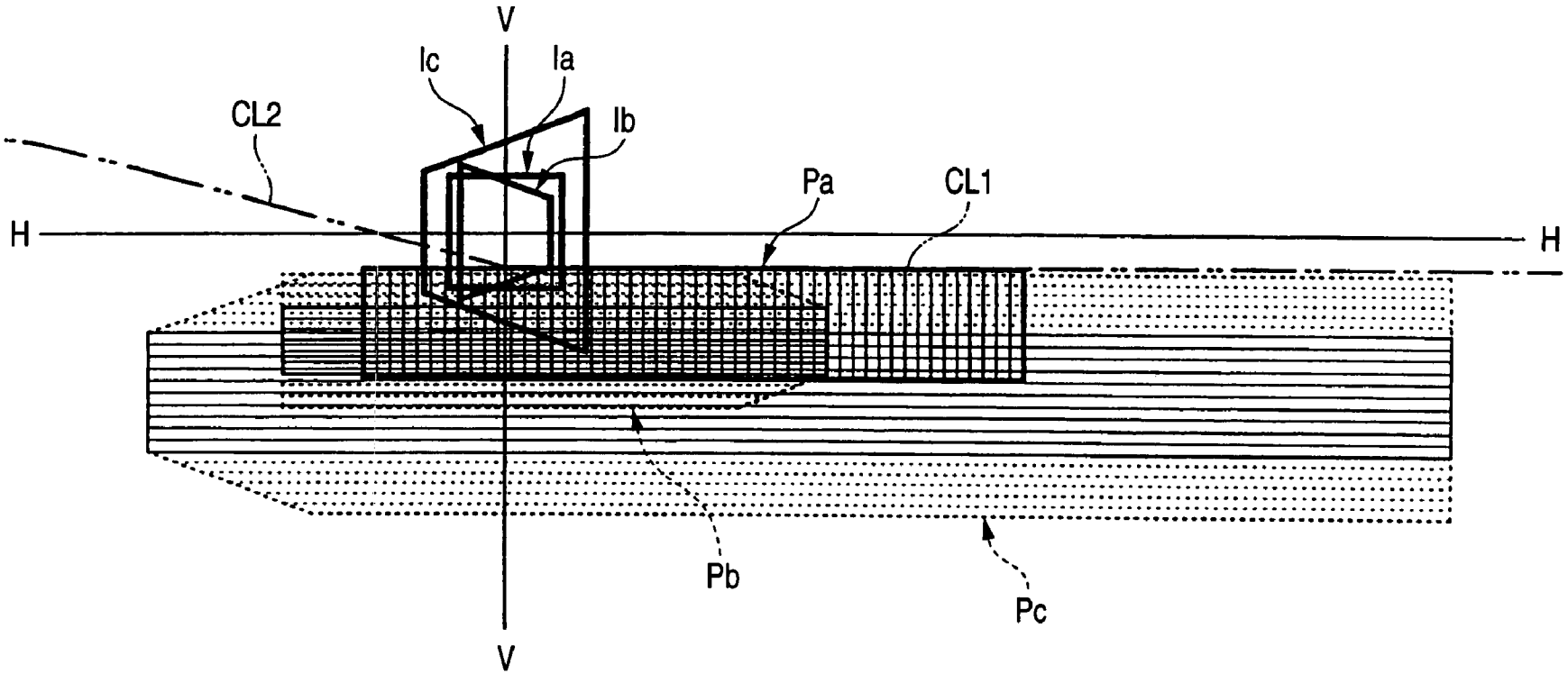
FIG. 5 is a view showing the image of the first light source and a horizontal cutoff line forming pattern formed on the virtual vertical screen by a light reflected from a reflecting region positioned in the almost front direction of the light emitting chip in a first reflector of the vehicle headlamp, according to an exemplary, non-limiting embodiment of the present invention.

The image of the first light source 16 is formed as an inverted image on the virtual vertical screen by the light reflected from the first reflector 18. At this time, if the reflecting surface 18*a* is a paraboloid of revolution, images Ia, Ib and Ic of the first light source 16 formed by the lights reflected from the reflecting regions Za, Zb and Zc have shapes obtained by rotating, by 180 degrees, the shape of the light emitting chip 22, which is shown in the solid line of FIG. 4(*b*). This effect is shown in FIG. 5.

In other words, the image Ia formed by the light reflected from the reflecting region Za becomes almost rectangular, and the images Ib and Ic formed by the lights reflected from the reflecting regions Zb and Zc become almost trapezoidal. In that case, the image Ib formed by the light reflected from the reflecting region Zb is smaller than the image Ic formed by the light reflected from the reflecting region Zc, depending on a difference in a distance from the light emitting chip 22 to each of the reflecting regions Za, Zb and Zc.

The images Ia, Ib and Ic of the first light source 16 are actually formed as the horizontal cutoff line forming pattern Pa and the horizontal cutoff line reinforcing patterns Pb and Pc by the deflecting and diffusing functions of the reflecting units 18*s* formed on the reflecting surface 18*a* of the first reflector 18.

In that case, the horizontal cutoff line forming pattern Pa is formed by downwardly deflecting the image Ia of the reflecting region Za to a position in which an upper edge thereof is level with the horizontal cutoff line CL1, and carrying out deflection and diffusion in a horizontal direction. At this time, the image Ia takes an almost rectangular shape and the upper edge thereof is extended in an almost horizontal direction. Also in the horizontal cutoff line forming pattern Pa, the upper edge has a high contrast ratio. Consequently, it is possible to obtain the clear horizontal cutoff line CL1.

Moreover, the horizontal cutoff line reinforcing patterns Pb and Pc are formed by downward deflecting the images Ib and Ic of the reflecting regions Zb and Zc to a position in which they are hidden under the horizontal cutoff line CL1, and carrying out deflection and diffusion in a horizontal direction. At this time, the images Ib and Ic take substantially trapezoidal shapes and have upper edges that extend obliquely. In the horizontal cutoff line reinforcing patterns Pb and Pc, the upper edges do not have high contrast ratios. Since the patterns Pb and Pc are hidden under the horizontal cutoff line CL1, however, glare generation can be prevented. By the horizontal cutoff line reinforcing patterns Pb and Pc, it is possible to maintain a brightness under the horizontal cutoff line forming pattern Pa and on both sides in the horizontal direction.

Figure 6:
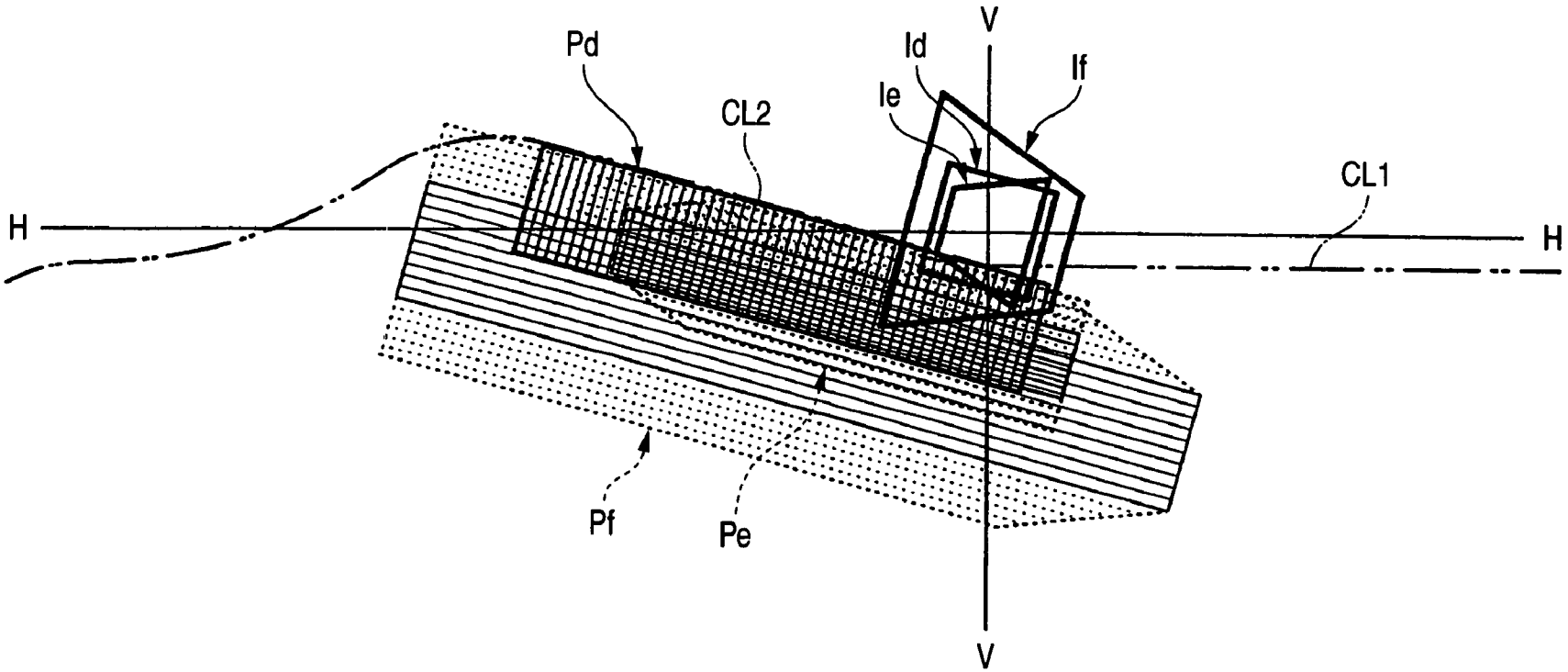
FIG. 6 is a view showing the image of a second light source and an oblique cutoff line forming pattern formed on the virtual vertical screen by a light reflected from a reflecting region positioned in the almost front direction of the light emitting chip in a second reflector of the vehicle headlamp according to an exemplary, non-limiting embodiment of the present invention.

On the other hand, the image of the second light source 26 is formed as an inverted image on the virtual vertical screen by the light reflected from the second reflector 28. If the reflecting surface 28*a* is a paraboloid of revolution, images Id, Ie and If of the second light source 26 formed by the lights reflected from the reflecting regions Zd, Ze and Zf have shapes obtained by rotating, by 180 degrees, the shape of the light emitting chip 22 shown in the solid line of FIG. 4(*b*) in an inclination state of about 15 degrees, as shown in FIG. 6.

In other words, the image Id formed by the light reflected from the reflecting region Zd becomes substantially rectangular, and the images Ie and If formed by the lights reflected from the reflecting regions Ze and Zf become substantially trapezoidal. In that case, the image Ie formed by the light reflected from the reflecting region Ze is smaller than the image If formed by the light reflected from the reflecting region Zf depending on a difference in a distance from the light emitting chip 22 to each of the reflecting regions Zd, Ze and Zf.

The images Id, Ie and If of the second light source 26 are formed as the oblique cutoff line forming pattern Pd and the oblique cutoff line reinforcing patterns Pe and Pf by the deflecting and diffusing functions of the reflecting units 28*s* formed on the reflecting surface 28*a* of the second reflector 28.

In that case, the oblique cutoff line forming pattern Pd is formed by downward deflecting the image Id of the reflecting region Zd to a position in which an upper edge thereof is on the level with the oblique cutoff line CL2 and carrying out deflection and diffusion in a direction which is inclined by about 15 degrees with respect to a horizontal direction. At this time, the image Id takes a substantially rectangular shape and the upper edge thereof is extended in a direction which is inclined by approximately 15 degrees with respect to the horizontal direction. Also in the oblique cutoff line forming pattern Pd, therefore, the upper edge has a high contrast ratio. Consequently, it is possible to obtain the clear oblique cutoff line CL2.

Moreover, the oblique cutoff line reinforcing patterns Pe and Pf are formed by downward deflecting the images Ie and If of the reflecting regions Ze and Zf to a position in which they are hidden under the oblique cutoff line CL2 and carrying out deflection and diffusion in a direction which is inclined by about 15 degrees with respect to the horizontal direction. At this time, the images Ie and If take substantially shapes and have upper edges extended in a different direction from the oblique cutoff line CL2. In the oblique cutoff line reinforcing patterns Pe and Pf, the upper edges do not have high contrast ratios. Since the patterns Pe and Pf are hidden under the oblique cutoff line CL2, however, glare generation can be prevented. By the oblique cutoff line reinforcing patterns Pe and Pf, it is possible to maintain a brightness under the oblique cutoff line forming pattern Pd and on both sides in the oblique direction.

As described above, the headlamp 10 for a vehicle according to the exemplary, non-limiting embodiment is constituted to form a light distribution pattern having the horizontal cutoff line CL1 by the first reflecting optical system 20 comprising the first light source 16 including the light emitting diode in which the rectangular light emitting chip 22 is covered with the hemispherical mold lens 24 and the first reflector 18 for reflecting a light emitted from the first light source 16 toward the front part of the lighting unit. The first light source 16 is provided such that the light emitting chip 22 is turned in the horizontal direction with one side of the light emitting chip 22 set almost horizontally, and furthermore, the first reflecting optical system 20 is constituted to form the horizontal cutoff line CL1 by selectively utilizing a light emitted from the first light source 16 and reflected by the first reflector 18 which is reflected in the reflecting region Za positioned in the almost front direction of the light emitting chip 22. Therefore, at least the following functions and advantages can be obtained.

The present invention has various advantages. For example, but not by way of limitation, the light emitting chip 22 of the first light source 16 is formed rectangularly and turned in the horizontal direction with the side set horizontally. Therefore, the inverted image of the first light source 16 formed on the virtual vertical screen provided in the forward part of the lighting unit by the light reflected in the reflecting region Za positioned in the almost front direction of the light emitting chip 22 becomes the almost rectangular image Ia having an upper edge extended almost horizontally. In the exemplary, non-limiting embodiment, the almost rectangular image Ia is utilized to form the horizontal cutoff line forming pattern Pa. Consequently, it is possible to obtain the clear horizontal cutoff line CL1. Thus, the generation of glare can be suppressed effectively.

In the embodiment, a light distribution pattern having the oblique cutoff line CL2 rising obliquely from the horizontal cutoff line CL1 at about 15 degrees is formed by the second reflecting optical system 30 comprising the second light source 26 including the light emitting diode in which the rectangular light emitting chip 22 is covered with the hemispherical mold lens 24 and the second reflector 28 for reflecting a light emitted from the second light source 26 toward the front part of the lighting unit. In that case, the second light source 26 is provided such that the light emitting chip 22 is turned in a direction which is downward inclined at about 15 degrees with respect to the horizontal direction with one side of the light emitting chip 22 set horizontally. Furthermore, the second reflecting optical system 30 forms the oblique cutoff line CL2 by selectively utilizing a light emitted from the second light source 26 and reflected by the second reflector 28 which is reflected in the reflecting region Zd positioned in the almost front direction of the light emitting chip 22. Therefore, the following functions and advantages can be obtained.

More specifically, the light emitting chip 22 of the second light source 26 is formed rectangularly and is turned in the direction which is downward inclined at about 15 degrees with respect to the horizontal direction with the side set horizontally. Therefore, the inverted image of the second light source 26 which is formed on the virtual vertical screen provided in the forward part of the lighting unit by the light reflected in the reflecting region Zd positioned in the almost front direction of the light emitting chip 22 becomes the almost rectangular image Id having an upper edge rising obliquely at about 15 degrees with respect to the horizontal direction. In the embodiment, the almost rectangular image Id is utilized to form the oblique cutoff line forming pattern Pd. Consequently, it is possible to obtain the clear oblique cutoff line CL2. Thus, the distant visibility of a self-car driver can be maintained, and furthermore, the generation of glare can be suppressed effectively.

In the embodiment, furthermore, the first reflector 18 and the second reflector 28 are formed integrally. Therefore, the positional relationship between the horizontal cutoff line CL1 and the oblique cutoff line CL2 can be decided. Moreover, the aiming regulation of the headlamp 10 for a vehicle can be collectively carried out for both of the first and second reflecting optical systems 20 and 30.

In the exemplary, non-limiting embodiment, when the horizontal cutoff line forming pattern Pa and the oblique cutoff line forming pattern Pd are formed, the image Ia of the reflecting region Za and the image Id of the reflecting region Zd are deflected downward to the position in which the upper edges thereof are level with the horizontal cutoff line CL1 and the oblique cutoff line CL2. The optical axes Ax1 and Ax2 may be previously set downward corresponding to the downward deflection. In such a case, the concavo-convex amount of each of the reflecting units 18*s* and 28*s* can be reduced. Consequently, it is possible to easily form the reflecting surfaces 18*a* and 28*a*.

While the lights emitted from the first and second light sources 16 and 26 which are reflected by the first and second reflectors 18 and 28 are subjected to deflecting and diffusing control by the reflecting units 18*s* and 28*s* formed on the reflecting surfaces 18*a* and 28*a* in the embodiment, it is also possible to employ a structure in which a plurality of lens units is formed on the transparent cover 14 and the deflecting and diffusing control is carried out by refraction.

While the headlamp 10 for a vehicle comprises one first reflecting optical system 20 and one second reflecting optical system 30 in the embodiment, it is also possible to employ a structure in which the first and second reflecting optical systems 20 and 30 are provided in plural sets. In such a case, the light distribution pattern PL for a low beam can have a higher brightness.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

We claim:

1. A headlamp for a vehicle, said headlamp having a first light distribution pattern having a horizontal cutoff line formed by a first reflecting optical system, comprising:

a first light source including; a first semiconductor light emitting unit in which a substantially rectangular first light emitting chip is covered by a substantially hemispherical first mold lens; and a first reflector reflecting light emitted from the first light source toward a front part of a lighting unit, wherein:

the first light source is oriented such that the first light emitting chip is positioned substantially horizontally with a side of the light emitting chip that is set substantially horizontally; and the first reflecting optical system forms the horizontal cutoff line by selectively utilizing the light emitted from the first light source and reflected by the first reflector in a first reflecting region positioned in a substantially front direction of the light emitting chip.

2. The headlamp according to claim 1, said headlamp having a second light distribution pattern having an oblique cutoff line rising from the horizontal cutoff line at an angle by a second reflecting optical system, comprising:

a second light source including; a second semiconductor light emitting unit in which a substantially rectangular second light emitting chip is covered with a second substantially hemispherical mold lens; and a second reflector reflecting light emitted from the second light source toward a front part of said lighting unit, wherein:

the second light source is oriented such that the second light emitting chip is inclined downward at said angle with respect to a horizontal direction with a side of the second light emitting chip that is set substantially horizontally; and the second reflecting optical system forms the oblique cutoff line by selectively utilizing light emitted from the second light source and reflected by the second reflector in a second reflecting region positioned in a substantially front direction of the light emitting chip.

3. The headlamp according to claim 2, wherein the first reflector and the second reflector are formed integrally with one another.

4. The headlamp of claim 3, wherein said first reflector and said second reflector are integrally formed on a common holder positioned therebetween.

5. The headlamp of claim 2, wherein said angle is about 15 degrees.

6. The headlamp of claim 2, wherein said angle is 15 degrees.

7. The headlamp of claim 1, wherein said first light reflecting region corresponds to an angular range of about 50 degrees including a central axis of light emitted by the first semiconductor light emitting unit.

8. The headlamp of claim 2, wherein said second light reflecting region corresponds to an angular range of about 50 degrees including a central axis of light emitted by the second semiconductor light emitting unit.

9. The headlamp of claim 1, said first reflector further comprising inner and outer peripheral sides that receive light generated at a peripheral region of the first light emitting chip.

10. The headlamp of claim 9, wherein the peripheral region corresponds to an area outside an angular range of 50 degrees including a central axis of light emitted by the first semiconductor light emitting unit.

11. The headlamp of claim 2, said second reflector further comprising inner and outer peripheral sides that receive light generated at a peripheral region of the second light emitting chip.

12. The headlamp of claim 11, wherein the peripheral region corresponds to an area outside an angular range of 50 degrees including a central axis of light emitted by the second semiconductor light emitting unit.

13. A headlamp having a light distribution pattern having a horizontal cutoff line and an oblique cutoff line rising from the horizontal cutoff line at an angle, formed by a reflecting optical system that comprises:

a first light source having a first semiconductor light emitting unit including a first light emitting chip covered by a first mold lens;

a first reflector reflecting light emitted from the first light source toward a front of a lighting unit;

a second light source having a second semiconductor light emitting unit including a second light emitting chip covered with a second mold lens; and a second reflector reflecting light emitted from the second light source toward a front of said lighting unit, wherein:

the first light emitting chip is positioned substantially horizontally with a side of the light emitting chip, which is set substantially horizontally;

the second light emitting chip is inclined downward at said angle with respect to said horizontally positioned first light emitting chip;

the horizontal cutoff line is formed by selectively utilizing the light emitted from the first light source and reflected by the first reflector in a first reflecting region positioned in front of the light emitting chip; and the oblique cutoff line is formed by selectively utilizing the light emitted from the second light source and reflected by the second reflector in a second reflecting region positioned in front of the light emitting chip.

14. The headlamp according to claim 13, wherein the first reflector and the second reflector are formed integrally with one another.

15. A headlamp having a light distribution pattern having a horizontal cutoff line and an oblique cutoff line rising from the horizontal cutoff line at an angle, formed by a reflecting optical system that comprises:

means for generating a first light output and a second light output; and means for reflecting said first light output and said second light output from said means for generating toward a front of a lighting unit to produce said horizontal cutoff line and said oblique cutoff line, respectively.

16. The headlamp according to claim 1, wherein the first semiconductor light emitting unit faces in a emitting direction perpendicular to a central axis of the first reflector.

17. The headlamp according to claim 13, wherein the first semiconductor light emitting unit faces in a emitting direction perpendicular to a central axis of the first reflector.

18. The headlamp according to claim 15, wherein the means for generating the first light output is arranged to emit light in a direction perpendicular to a central axis of the means for reflecting the first light output.

19. The headlamp according to claim 1, wherein the first light source further comprises a substrate having an upper surface upon which the rectangular first light emitting chip and substantially hemispherical first mold lens are arranged.

20. The headlamp according to claim 13, wherein the first light source further comprises a substrate having an upper surface upon which the first light emitting chip and first mold lens are arranged.

* * * * *